US005549062A

United States Patent [19]

Yamashita et al.

[11] Patent Number: 5,549,062

[45] Date of Patent: Aug. 27, 1996

[54] SHUTTLE HOOK DRIVING DEVICE FOR A SEWING MACHINE

[75] Inventors: Takashi Yamashita; Minoru Wada, both of Tokyo, Japan

[73] Assignee: Juki Corporation, Tokyo, Japan

[21] Appl. No.: 496,095

[22] Filed: Jun. 28, 1995

[30] Foreign Application Priority Data

Jun. 29, 1994 [JP] Japan ..... 6-148163

[51] Int. Cl.[6] ..... D05B 69/16

[52] U.S. Cl. ..... 112/220; 112/221; 112/168; 112/182

[58] Field of Search ..... 112/220, 168, 112/181, 182, 190, 192, 228, 229, 232, 221, 233, 451; 74/591, 603, 604

[56] References Cited

U.S. PATENT DOCUMENTS

| | | | |
|---|---|---|---|
| 2,324,598 | 7/1943 | Sauer | 112/221 |
| 2,725,024 | 11/1955 | Ayres | 112/221 XR |
| 2,958,300 | 11/1960 | Zylbert | 112/192 |
| 3,103,190 | 9/1963 | Wiehl | 112/220 |
| 3,492,959 | 2/1970 | Wenz et al. | 112/182 XR |
| 4,333,410 | 6/1982 | Taketomi | 112/168 XR |
| 4,616,585 | 10/1986 | Marcandalli | 112/221 |

FOREIGN PATENT DOCUMENTS 99353 10/1933 Japan .

*Primary Examiner*—Ismael Izaguirre

*Attorney, Agent, or Firm*—Morgan, Lewis & Bockius LLP

[57] ABSTRACT

A shuttle hook driving device for driving a shuttle hook having a beak disposed between a needle drop position and a bobbin thread lead-out point of a bobbin in a sewing machine which includes a main shaft, a needle bar, a thread take-up lever, and a conversion mechanism for converting a rotation of the main shaft into an oscillating motion, the shuttle hook driving device comprises: a counter balance connected to the needle bar and the thread take-up lever, the counter balance being mounted on the main shaft such that the counter balance is displaced a predetermined angle with respect to the main shaft as compared with a standard sewing machine; an output shaft received the oscillating motion from the conversion mechanism, the output shaft being connected to the conversion device in right-left inverted relation with respect to an axis thereof as compared with the standard sewing machine, using an uppermost point of the needle bar as a reference; and a driver connected to the output shaft, for driving the shuttle hook.

6 Claims, 7 Drawing Sheets

DBS

DPS

SHUTTLE HOOK DRIVING DEVICE FOR A SEWING MACHINE

BACKGROUND OF THE INVENTION

1. Field of the Invention

This invention relates to a shuttle hook driving device for a sewing machine, and more particularly to a shuttle hook driving device for a sewing machine of the type which employs a half-turn shuttle hook of the so-called DPS-type.

2. Description of Related Art

Shuttle hooks for a sewing machine are classified into a full-turn type and a half-turn type, and such half-turn shuttle hooks are classified into the type (hereinafter referred to as "DBS-type shuttle hook) in which a needle is disposed between an upper thread loop and a bobbin (that is, a needle drop position is disposed between a bobbin thread lead-out point of the bobbin and a beak of the shuttle hook) and the type (hereinafter referred to as "DPS-type shuttle hook") in which an upper thread loop is disposed between a needle and a bobbin (that is, a beak of the shuttle hook is disposed between a needle drop position and a bobbin thread lead-out point of the bobbin.

As used in the description and in the appended claims, the word "a standard sewing machine" means a sewing machine in which the needle drop position is disposed between the bobbin thread lead-out point of the bobbin and the beak of the shuttle hook.

In a sewing machine having the DBS-type shuttle hook, perfect stitches can be formed during a forward feed (that is, a feed from right to left as viewed from the operator side), while hitch stitches can be formed during a reverse feed (that is, a feed from left to right). Thus, this type of sewing machine has been widely used for forming general lock stitching.

More specifically, for general lock stitching, ordinary straight stitching must employ perfect stitches in view of the quality of the stitch. Because the stitching may become undone at the start and end of the stitching, hitch stitches are preferable to prevent the stitching from becoming undone. For this reason, the DBS-type shuttle hook is employed.

Incidentally, the sewing machine having the DBS-type shuttle hook is not suitable for omnidirectional stitching.

A sewing machine having the DPS-type shuttle hook is also known (For example, see Japanese Patent No. 99353), and is suitable for omnidirectional stitching because perfect stitches are formed during forward and reverse feeds. However, such a sewing machine has not yet been widely used.

Incidentally, this DPS-type shuttle hook can accommodate a change in thickness of work, and is suitable for situations where thick work or a thick thread is used.

FIG. 5 shows the construction of a drive device for a thread take-up lever and a needle bar in a sewing machine of the general type. This construction includes a main shaft (upper shaft) 1, a crank section 2, a counter balance 21, the thread take-up lever 22, a needle-bar crank 23, a needle-bar crank rod 24, the needle bar 25, and a needle 113.

FIG. 6 is a continuation of FIG. 5, and shows the construction of a shuttle hook driving device. This construction further includes a crank rod 3, an oscillating rock member 4, an oscillating rock shaft 4*a*, gears 5 and 6, a lower shaft 7, a shuttle race body 8, a driver 109, a shuttle hook (DBS-type shuttle hook) 111, a shuttle race ring 11, a bobbin case 100, and a bobbin 103.

FIG. 7 shows the conventional bobbin case 100 used for an ordinary half-turn shuttle hook. As shown in FIG. 7, the bobbin case 100 has an engaging member 101 for rotation prevention purposes, and a threading hole 102 is formed through this engaging member 101. A bobbin thread 104, fed from the bobbin 103 received in the bobbin case 100, is passed through the threading hole 102 in the engaging member 101.

The bobbin case is mounted on the front side of the sewing machine so that the operator can easily mount and remove it.

Since the sewing thread used in a sewing machine is basically of a Z-twist type, the shuttle hook needs to be rotated in a direction to twist the upper thread. More specifically, the direction of rotation of the DBS-type shuttle hook should preferably be clockwise as viewed from the operator side, and the direction of rotation of the DPS-type shuttle hook should preferably be counterclockwise.

In the general-type sewing machine using the above DBS-type shuttle hook, a curve A of lift of the thread by the thread take-up lever 22 and a curve B of take-up of the thread by the shuttle hook (DBS-type shuttle hook 111) are determined as shown in FIGS. 3 and 4, and these are thought to be the most ideal characteristics.

More specifically, it is well known that by providing the curve B of take-up of the thread by the shuttle hook (DBS-type shuttle hook 111) with respect to the curve A of lift of the thread by the thread take-up lever 22, good stitching free from improper thread distribution can be effected without causing undue noises and vibrations.

Next, the case where the DBS-type shuttle hook is used will be compared with the case where the DPS-type shuttle hook is used.

FIGS. 8A and 8B show a comparison between the case where the DBS-type shuttle hook is used and the case where the DPS-type shuttle hook is used. More specifically, FIG. 8A shows the DBS shuttle hook 111, a beak 112 of this shuttle hook, a needle 113, an upper thread 114, and an upper thread loop R. FIG. 8B shows the DPS shuttle hook 115, and a beak 116 of this shuttle hook. There is a problem that a distance (2) (FIG. 8B) between a needle drop point and a bobbin thread lead-out point, in the case of using the DPS shuttle hook, is longer than a distance (1) (FIG. 8A) between a needle drop point and a bobbin thread lead-out point in the case of using the DBS-type shuttle hook.

Namely, in the basic construction of the DPS-type shuttle hook 115, the distance (2) between the bobbin thread lead-out point and the needle drop point must be laterally shifted or offset by an amount equal to the width of the race of the shuttle hook plus $\alpha$ as compared with the distance (1) between the needle drop point and the bobbin thread lead-out point in the DBS-type shuttle hook.

As described above, the direction of rotation of the DBS-type shuttle hook is clockwise whereas the direction of rotation of the DPS-type shuttle hook is counterclockwise, and therefore the construction of the shuttle hook driving device must be taken into consideration in view of noises, vibrations and stitching.

More specifically, the directions of rotation of the DBS-type shuttle hook 111 and the DPS-type shuttle hook 115 are opposite to each other, and therefore if all of rotation transmitting parts of one of the two shuttle hooks are made symmetrically reverse in construction to the corresponding parts of the other, all those parts of one shuttle hook must be newly prepared. As a result, construction costs are greatly increased.

Therefore, it is necessary that the rotation transmitting parts used in the sewing machine with the DBS-type shuttle hook 11 be suitable for use in the sewing machine with the DPS-type shuttle hook as much as possible, thereby suppressing the increase of the cost of construction.

For this reason, it would be advantageous to have a shuttle hook driving device of the simple right-left inverted phase type in which in the case of the DPS-type shuttle hook 115, the oscillating rock member 4 is simply disposed in right-left inverted relation to the oscillating rock member for the DBS-type shuttle hook 111, where the top dead center of the needle bar 25 as a reference.

For such a shuttle hook driving device of the simple right-left inverted phase type, a curve of take-up of the thread by the shuttle hook (DPS-type shuttle hook 115) is represented by D in FIGS. 3 and 4. This curve D is much lower than the ideal curve B when the rotational angle of the main shaft (upper shaft 1) is in the range of between about 210° and about 330°.

Namely, at that region where the thread take-up characteristics are lowered, the acceleration of the driver 109 becomes much higher than the standard during the take-up of the loop R of the upper thread 114 by the beak 116 of the DPS-type shuttle hook 115, so that noises and vibrations develop. In addition an improper thread distribution will develop, so that a line of stitches is interrupted.

Therefore, in the case of the DPS-type shuttle hook 115, the above-mentioned shuttle hook driving device of the simple right-left inverted phase type can be not used.

It would be advantageous to provide a shuttle hook driving device of the 180° inverted phase type in which, in the case of the DPS-type shuttle hook 115, the crank section 2 of the main shaft (upper shaft 1) is disposed in up-down inverted relation to the crank section for the DBS-type shuttle hook 111 where the top dead center of the needle bar 25 as a reference.

For a shuttle hook driving device of the 180° inverted phase type, however, a curve of the take-up of the thread by the shuttle hook (DPS-type shuttle hook 115) is represented by C in FIGS. 3 and 4, and this curve C is closer to the ideal curve B than the thread take-up curve D is, but is lower than the ideal curve B when the rotational angle of the main shaft (upper shaft 1) is in the range of between about 210° and about 330°.

Namely, where the oscillating rock member 4 is disposed in right-left inverted relation to the oscillating rock member for the DBS-type shuttle hook, at that region where the thread take-up characteristics are lowered, the acceleration of the driver 109 becomes higher than the standard during the take-up of the loop R of the upper thread 114 by the beak 116 of the DPS-type shuttle hook 115. This causes noises and vibrations to develop, and also results in an improper thread distribution, so that a line of stitches is interrupted.

Therefore, in the case of the DPS-type shuttle hook, the above-mentioned shuttle hook driving device of the 180° inverted phase type can not be used.

SUMMARY OF THE INVENTION

It is therefore an object of the present invention to provide a shuttle hook driving device for a sewing machine using a DPS-type shuttle hook, having such an ideal thread take-up curve that good stitching or sewing free from improper thread distribution can be produced without causing undue noises and vibrations, as in a sewing machine using a DBS-type shuttle hook.

In order to achieve the object, a first aspect of the present invention includes a shuttle hook driving device for driving a shuttle hook having a beak disposed between a needle drop position and a bobbin thread lead-out point of a bobbin in a sewing machine which includes a main shaft, a needle bar, a thread take-up lever, and a conversion mechanism for converting a rotation of the main shaft into an oscillating motion. The shuttle hook driving device comprises: a counter balance connected to the needle bar and the thread take-up lever, the counter balance being mounted on the main shaft such that the counter balance is displaced a predetermined angle with respect to the main shaft as compared with a standard sewing machine; an output shaft receives the oscillating motion from the conversion mechanism, the output shaft being connected to the conversion mechanism in right-left inverted relation with respect to an axis thereof as compared with the standard sewing machine, using an uppermost point of the needle bar as a reference; and a driver connected to the output shaft, for driving the shuttle hook.

A second aspect of the invention provides for the shuttle hook driving device according to the first aspects, of the invention, wherein the conversion mechanism comprises a oscillating rock member, and the position of the oscillating rock member is right-left inverted as compared with the standard sewing machine.

A third aspect of the invention provides for the shuttle hook driving device according to either one of the first or second aspect, of the invention, wherein the counter balance is mounted on the main shaft such that the counter balance is displaced an angle of about 7° with respect to the main shaft in a direction opposite to a rotational direction of the main shaft as compared with the standard sewing machine.

In the sewing machine using the DPS-type shuttle hook according to the present invention, the output shaft is connected to the conversion mechanism (which converts the rotational motion of the main shaft into an oscillating movement) in right-left inverted relation with respect to an axis thereof as compared with the standard sewing machine with the DBS-type shuttle hook, using the top dead center of the needle bar as a reference. In addition the counter balance is mounted on the main shaft in such a manner that the counter balance is displaced a predetermined angle with respect to the main shaft as compared with the standard sewing machine. With this arrangement, a curve of take-up of the thread by the DPS-type shuttle hook can be substantially similar to a characteristic curve of take-up of a thread by the DBS-type shuttle hook.

Therefore, even in the sewing machine using the DPS-type shuttle hook, the same rotation transmitting parts as those used in the sewing machine using the DBS-type shuttle hook can be used as much as possible in order to suppresses the cost increase. In addition, good stitching free from improper thread distribution can be effected without causing undue noises and vibrations.

In the sewing machine using the DPS-type shuttle hook, the position of the oscillating rock member of the conversion means is right-left inverted as compared with the standard sewing machine using the DBS-type shuttle hook. By changing the positional relation of the oscillating rock member, the ideal thread take-up curve can be obtained. Using the same oscillating rock member and crank rod as those used in the sewing machine employing the DBS-type shuttle hook.

In the sewing machine using the DPS-type shuttle hook, the counter balance is mounted on the main shaft in such a manner that the counter balance is displaced an angle of about 7° with respect to the main shaft in a direction opposite to a rotational direction of the main shaft as compared with the standard sewing machine employing the DBS-type shuttle hook. By thus simply changing the positional relation of the counter balance, the ideal thread take-up curve can be obtained, using the same counter balance, needle bar crank and needle bar crank rod as those used in the sewing machine employing the DBS-type shuttle hook.

DETAILED DESCRIPTION OF THE PREFERRED EMBODIMENTS

A preferred embodiment of a shuttle hook driving device of the present invention for a sewing machine will now be described with reference to FIGS. 1 to 4.

Figure 1:
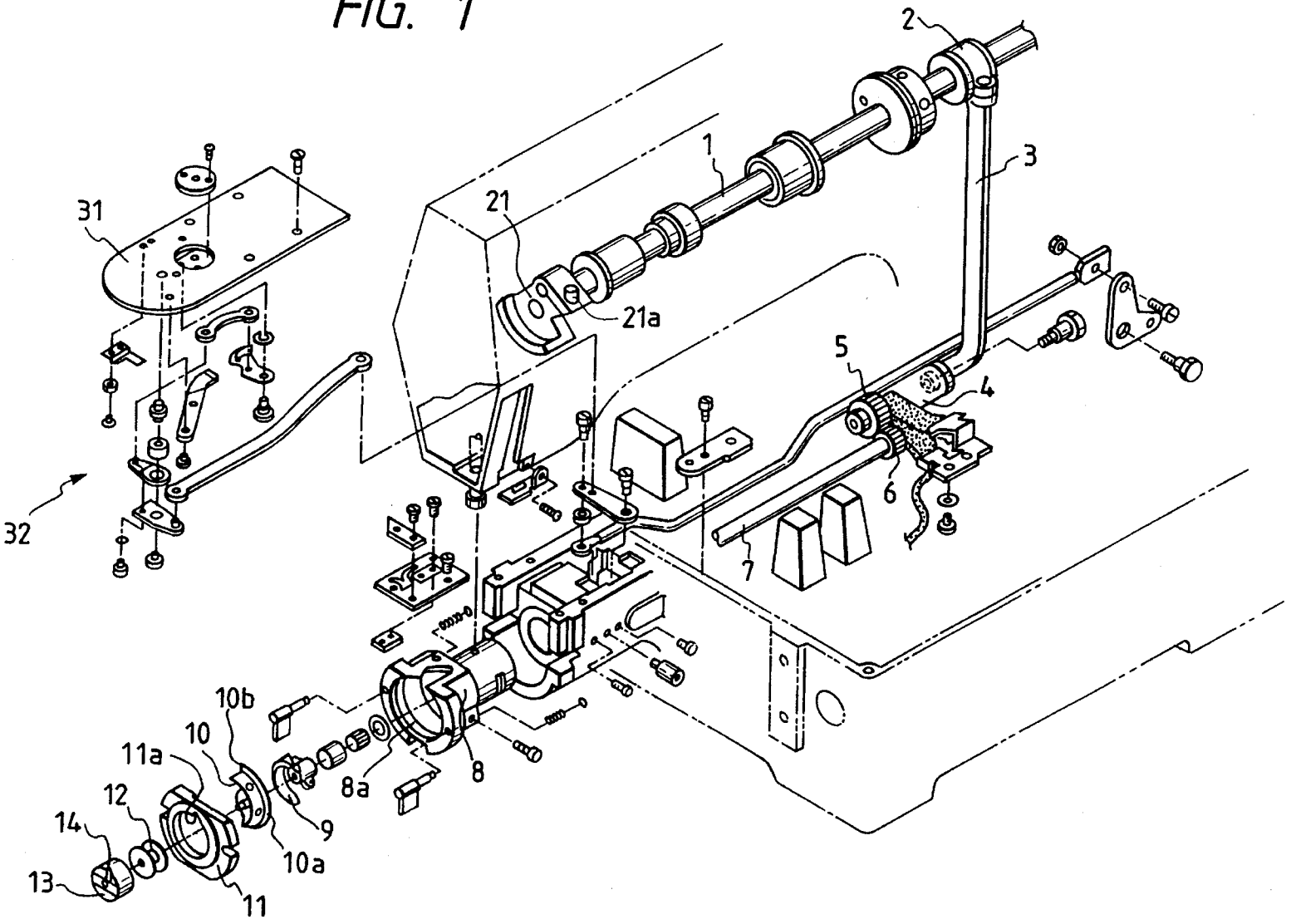
FIG. 1 is an exploded, perspective view showing a shuttle hook driving device according to the present invention.

FIG. 1 is an exploded, perspective view showing the sewing machine including one preferred embodiment of the shuttle hook driving device of the invention. This construction includes a main shaft (upper shaft) 1, a crank section 2, a crank rod 3, a oscillating rock member 4, gears 5 and 6, an output shaft (lower shaft) 7, a shuttle race body 8, a driver 9, a shuttle hook (DPS-type shuttle hook) 10, a shuttle race ring 11, a bobbin 12, a bobbin case 13, an engaging member 14, a counter balance 21, a mounting screw 21*a*, a needle plate 31, and a thread trimmer 32.

The crank section 2 is provided on the upper shaft (main shaft) 1 of the sewing machine, and a pulley (not shown) to which a driving force of a motor is applied through a belt is mounted on a right end portion (FIG. 1) of this upper shaft 1. The crank rod 3 is connected at its upper end to the crank section 2, and is also connected at its lower end to the oscillating rock member 4 in eccentric relation thereto.

The gear 6 in mesh with the gear 5 mounted on the oscillating rock member 4 is mounted on the lower shaft (output shaft) 7. The shuttle race body 8 fixed to a sewing machine body is provided at the left end portion (FIG. 1) of the lower shaft 7.

Thus, the crank section 2, the crank rod 3 and the oscillating rock member 4 jointly constitute a crank mechanism serving as conversion means for converting fully rotational motion of the upper shaft 1 into an oscillating movement of the lower shaft 7.

The driver 9, integrally connected to the left end of the lower shaft 7, is rotatably received in the shuttle race body 8. The DPS-type shuttle hook 10, driven by this driver 9, is also rotatably received in the shuttle race body 8.

A race 10*a* formed at an outer periphery of the DPS-type shuttle hook 10 is slidably supported by a race 8*a* formed at an inner periphery of the shuttle race body 8, and a beak 10*b* is formed at the extremity of the race 10*a*. The direction of rotation of the DPS-type shuttle hook 10 driven by the driver 9 is counterclockwise.

The shuttle race ring 11 is fixedly secured to an open portion of the shuttle race body 8, and the bobbin case 13 holding the bobbin 12 therein is loaded into the shuttle race body 8 through an opening in the shuttle hook pressor foot 11.

The bobbin case 13 has an engaging member 14 projected from the outer periphery thereof, and an engaging groove 11a engageable with the engaging member 14 is formed in the shuttle race ring 11.

Figure 2:
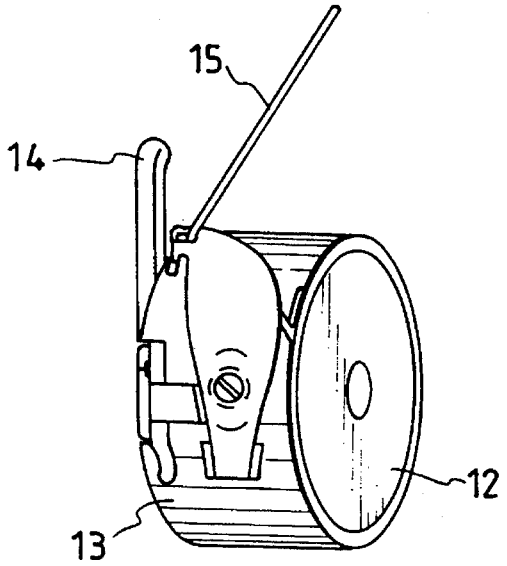
FIG. 2 is a perspective view of a bobbin case accommodating therein a bobbin shown in FIG. 1.
Figure 7:
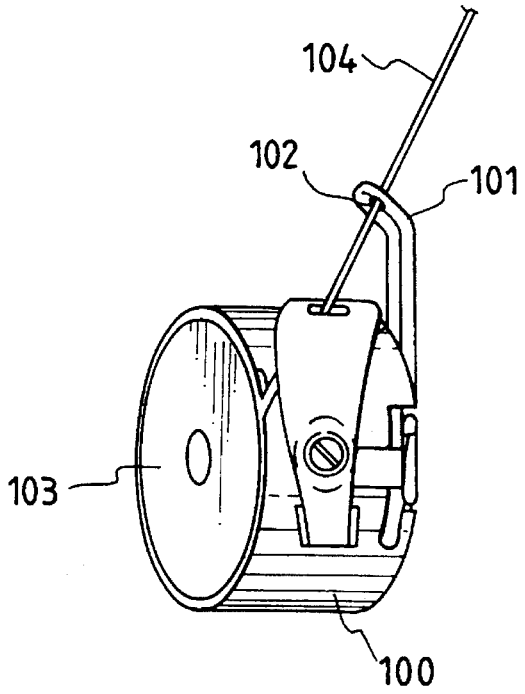
FIG. 7 is a perspective view of a conventional bobbin case used in an ordinary half-turn shuttle hook.

As shown in FIG. 2, the amount of projection of the engaging member 14 from the outer periphery of the bobbin case 13 is shorter than that of the conventional construction, and this engaging member 14 does not have a threading hole as provided in the conventional construction. Therefore, a bobbin thread 15 wound on the bobbin 12 is fed to be kept over the outer periphery of the bobbin case 13 not via the engaging member 14.

Specifically, the engaging member 14 is set to a specified length in accordance with the positional relation between the engaging member 14 and the driver 9. More specifically, this length is so determined that the upper end of the engaging member 14 of the bobbin case 13 is disposed at a level below the upper surface of the driver 9 when the rotational angle of the upper shaft 1 is in the range from 5° to 35°, with a top dead center of a needle bar used as a reference (0°).

Figure 5:
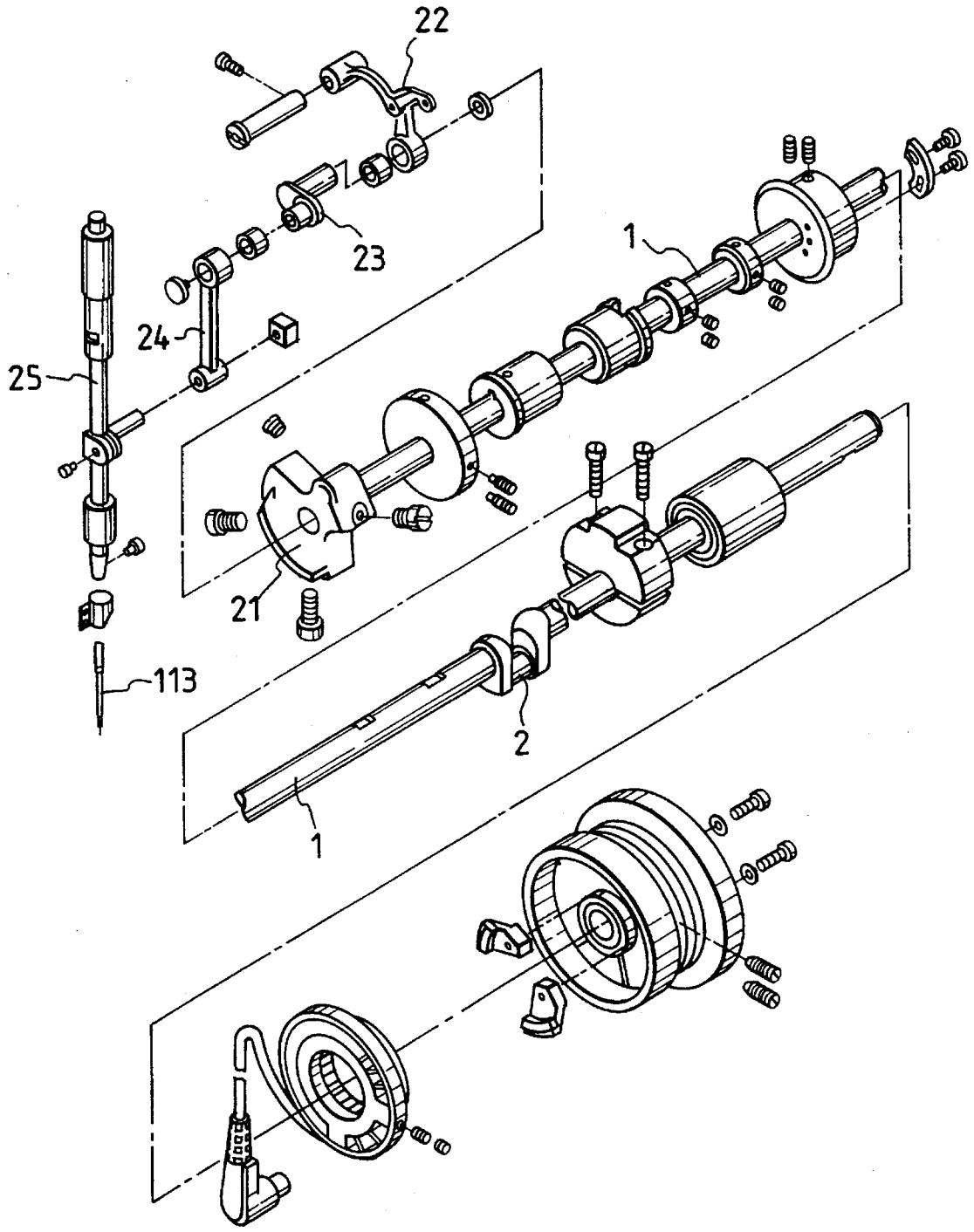
FIG. 5 is an exploded perspective view of an ordinary sewing machine, showing a drive device for a thread take-up lever and a needle bar.
Figure 6:
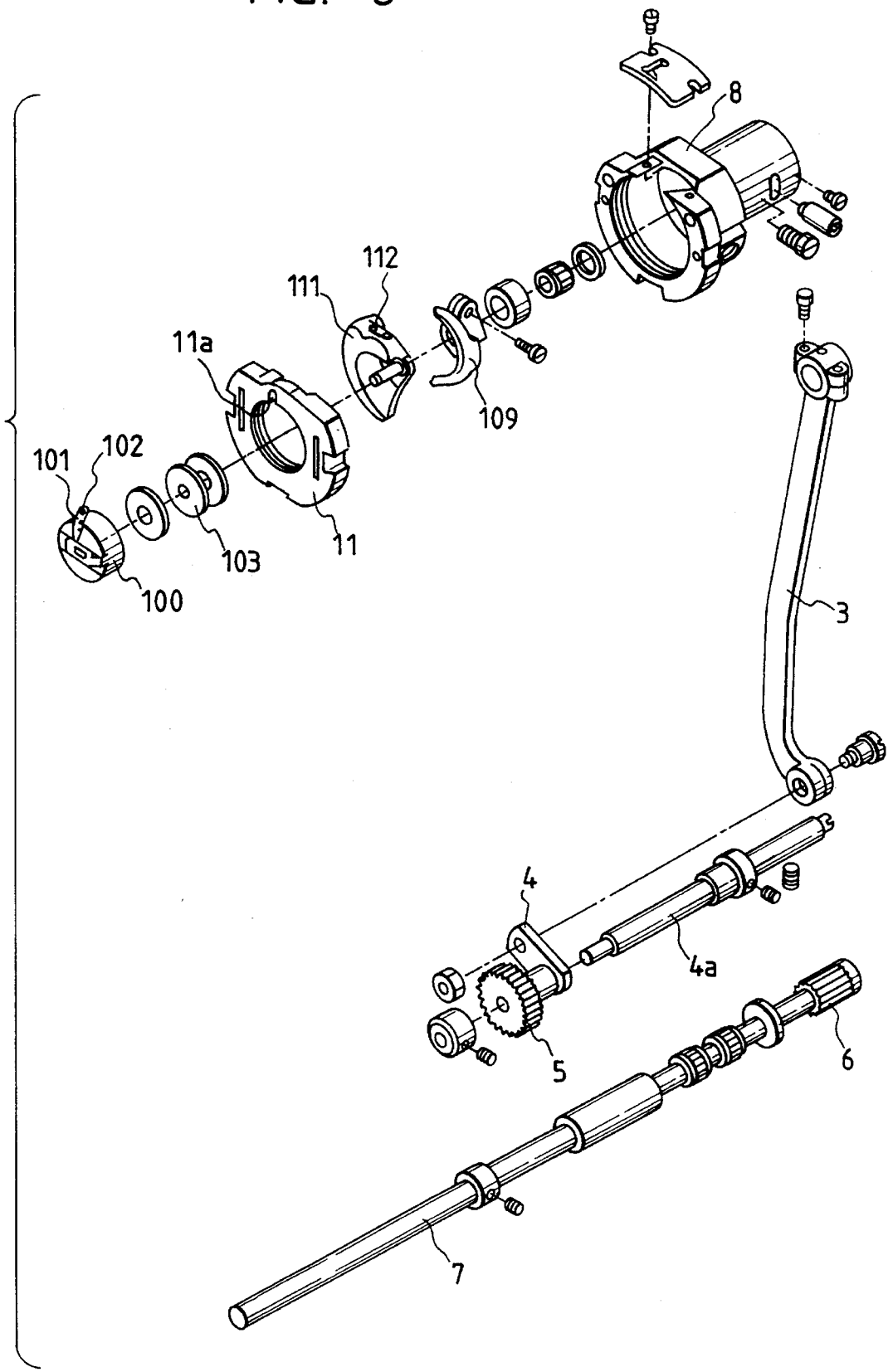
FIG. 6 is an exploded perspective view which is a continuation of FIG. 5, and shows a shuttle hook driving device.
Figure 8A:
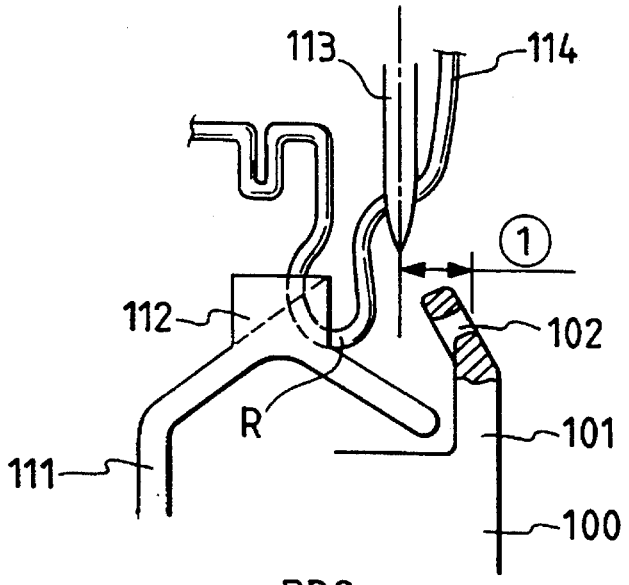
FIG. 8A is a partly-broken, side-elevational view showing the distance between a needle drop point and a bobbin thread lead-out point in the case of using a DBS-type shuttle hook.
Figure 8B:
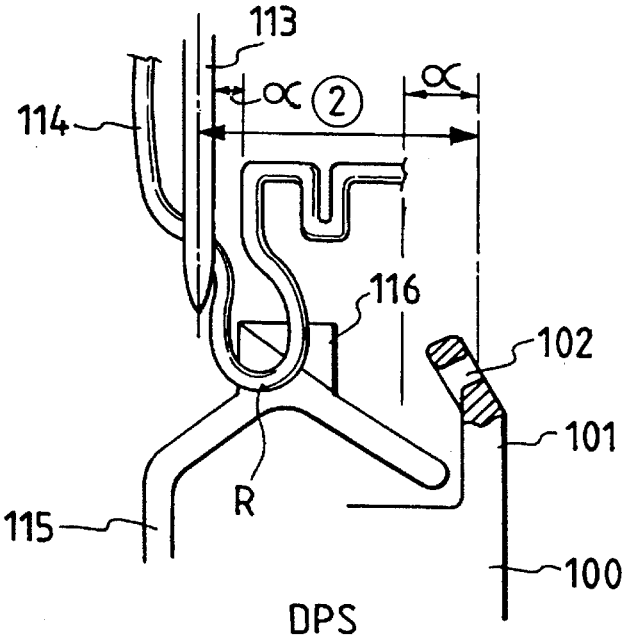
FIG. 8B is a partly-broken, side-elevational view showing the distance between a needle drop point and a bobbin thread lead-out point in the case of using a DPS-type shuttle hook.

The counter balance 21 is integrally mounted on the left end of the upper shaft 1 by the mounting screw 21*a*, and a thread take-up lever 22, a needle bar crank 23, a needle bar crank rod 24, the needle bar 25, and a needle 113 are connected to the counter balance 21 as shown in FIG. 5.

The needle plate 31 is provided above the shuttle race body 8, and the thread trimmer 32 and others are provided between the needle plate 31 and the shuttle race body 8.

In the above sewing machine, the driving force of the motor is first inputted to the pulley via the belt to fully rotate the upper shaft 1. The rotation of the upper shaft 1 drives the needle 113 via the counter balance 21, the thread take-up lever 22, the needle bar crank 23, the needle bar crank rod 24 and the needle bar 25. At the same time, the fully rotational motion of the upper shaft 1 is converted into a swinging movement of the oscillating rock member 4 via the crank section 2 and the crank rod 3.

Further, the swinging movement of the oscillating rock member 4 is converted into a half-turn motion of the lower shaft 7 via the gears 5 and 6. Therefore, the DPS-type shuttle hook 10 is driven by the driver 9 (integrally connected to the lower shaft 7) to make a half-turn motion in a counterclockwise direction.

As shown in FIG. 1, in the sewing machine using the DPS-type shuttle hook 10 according to the present invention, the crank rod 3 and the oscillating rock member 4 are disposed in right-left inverted relation to those used for the above-mentioned DBS-type shuttle hook 111, using the top dead center of the needle bar 25 as a reference. In addition, the counter balance 21 is mounted on the upper shaft 1 by the mounting screw 21*a* in such a manner that the counter balance 21 is displaced an angle of about 7° with respect to the upper shaft 1 in a direction opposite to the rotational direction of this upper shaft. This will be readily appreciated from a comparison with FIG. 5.

Figure 3:
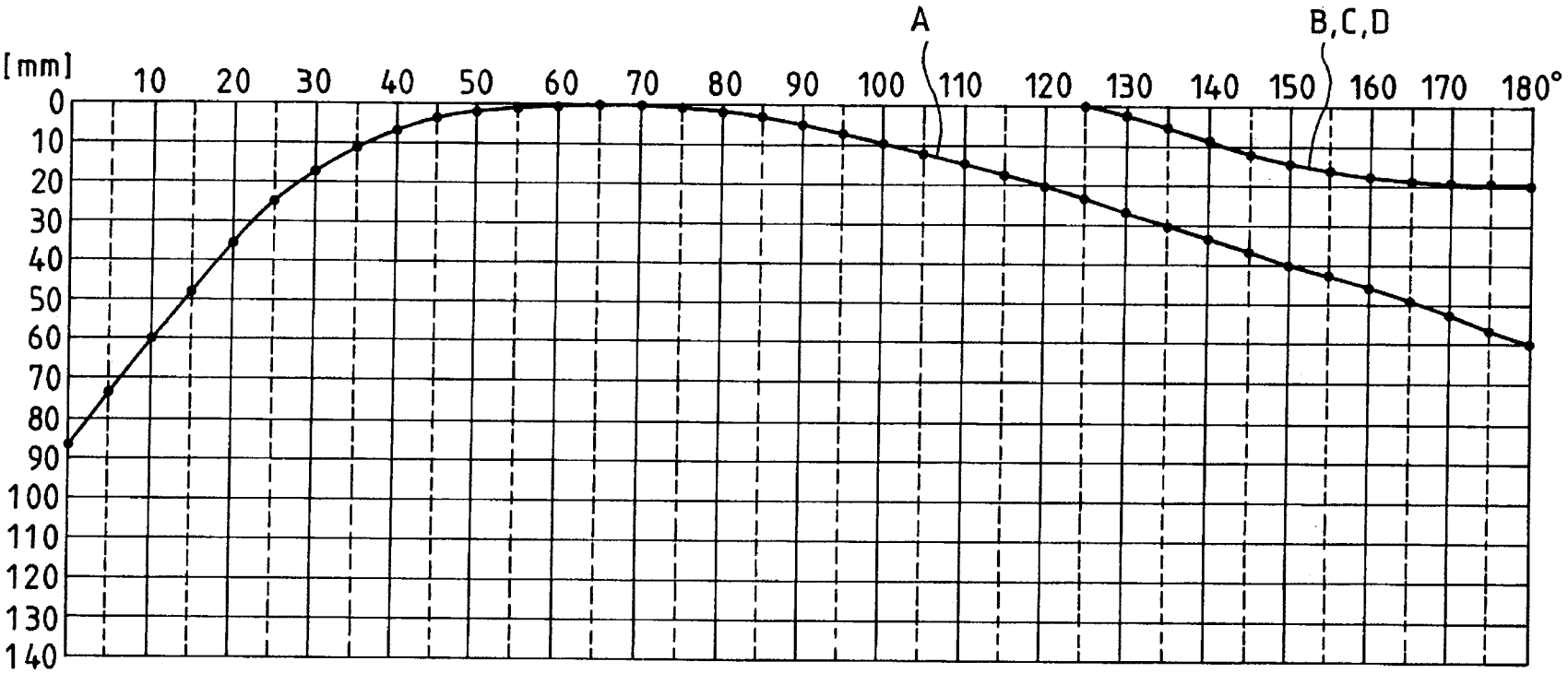
FIG. 3 is a diagram showing performance characteristics of thread take-up operations of a take-up lever and the shuttle hook, which are plotted by curves, where the main shaft of the sewing machine is rotated through angles of 0° to 180°.
Figure 4:
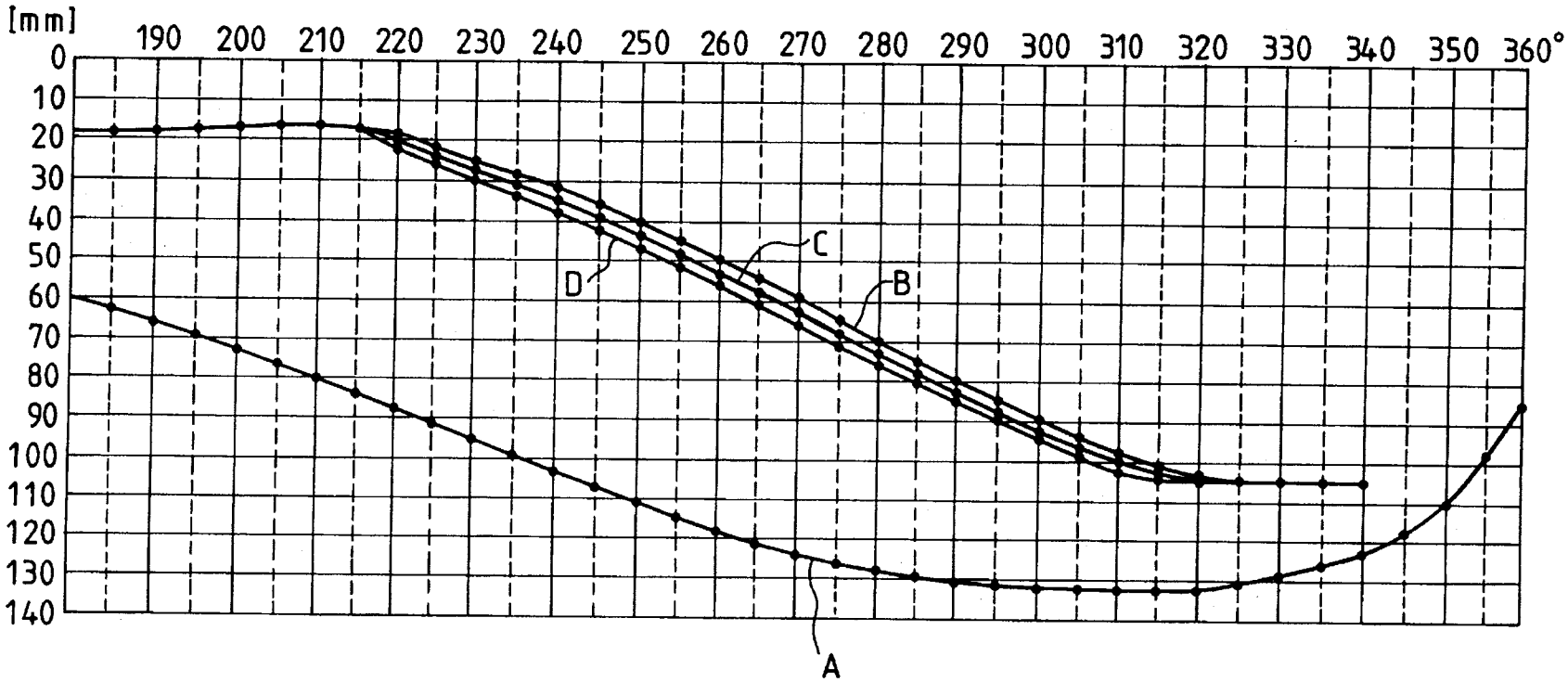
FIG. 4 is a diagram similar to FIG. 3 but showing performance characteristics of thread take-up generations where the main shaft of the sewing machine is rotated through angles of 180° to 360°.

In the shuttle hook driving device of the above construction, although the sewing machine uses the DPS-type shuttle hook 10, a characteristic curve of take-up of the thread by the DPS-type shuttle hook 10, which was substantially similar to the ideal characteristic curve B as shown in the characteristic diagrams of FIGS. 3 and 4, was obtained. Namely, the ideal characteristics, which were substantially similar to the thread take-up curve B achieved by the DBS-type shuttle hook 111, were obtained.

Therefore, most of all rotation transmitting parts (that is, the main shaft 1, the crank section 2, the gears 5 and 6, the lower shaft 7, the thread take-up lever 22, the needle bar crank 23, and the needle bar crank rod 24, and particularly the crank rod 3, the oscillating rock member 4, and the counter balance 21) as those used in the sewing machine using the DBS-type shuttle hook 111 can be all used in the sewing machine using the DPS-type shuttle hook 10. Thus, no new ports are needed, and the cost increase can be suppressed.

In addition, the sewing machine using the DPS-type shuttle hook 10 successfully reduces noises and vibrations, and achieves good stitching free from improper thread distribution as in the sewing machine using the DBS-type shuttle hook 111.

In the above embodiment, although the crank mechanism is used as the conversion mechanism for converting the rotational motion of the main shaft into the oscillating movement, the present invention is not to be limited to such an arrangement, and the conversion means may comprises a combination of a transmitting means, such as a timing belt mechanism or a shaft drive mechanism, and a crank mechanism.

Other power transmitting mechanism may be used, and the details of the other portions may also be suitably modified.

As described above, in the shuttle hook driving device of the invention for the sewing machine, the output shaft is connected to the conversion means (which converts the rotational motion of the main shaft into an oscillating movement) in right-left inverted relation with respect to an axis thereof as compared with the standard sewing machine with the DBS-type shuttle hook where the top dead center of the needle bar is used as a reference. In addition the counter balance is mounted on the main shaft in such a manner that the counter balance is displaced a predetermined angle with respect to the main shaft as compared with the standard sewing machine. With this arrangement, a curve of take-up of the thread by the DPS-type shuttle hook can be substantially similar to a characteristic curve of take-up of a thread by the DBS-type shuttle hook.

Therefore, even in the sewing machine using the DPS-type shuttle hook, most or all of the same rotation transmitting parts as those used in the sewing machine using the DBS-type shuttle hook can be used in order to suppresses the cost increase, and good stitching free from improper thread distribution can be effected without causing undue noises and vibrations.

Furthermore, the position of the oscillating rock member of the conversion means is right-left inverted as compared with the standard sewing machine using the DBS-type shuttle hook. Even in the sewing machine using the DPS-type shuttle hook, by simply changing the positional relation of the oscillating rock member, the ideal thread take-up curve can be obtained, using the same oscillating rock member and crank rod as those used in the sewing machine employing the DBS-type shuttle hook.

Still further, the counter balance is mounted on the main shaft in such a manner that the counter balance is displaced an angle of about 7° with respect to the main shaft in a direction opposite to a rotational direction of the main shaft as compared with the standard sewing machine employing the DBS-type shuttle hook. Even in the sewing machine using the DPS-type shuttle hook, by simply changing the positional relation of the counter balance, the ideal thread take-up curve can be obtained, using the same counter balance, needle bar crank and needle bar crank rod as those used in the sewing machine employing the DBS-type shuttle hook.

What is claimed is:

1. A shuttle hook driving device for driving a shuttle hook having a beak disposed between a needle drop position and a bobbin thread lead-out point of a bobbin in a sewing machine which includes a main shaft, a needle bar, a thread take-up lever, and a conversion mechanism for converting a rotation of the main shaft into an oscillating motion, the shuttle hook driving device comprising;

a counter balance connected to the needle bar and the thread take-up lever, the counter balance being mounted on the main shaft such that the counter balance is positioned at a predetermined angle with respect to the main shaft as compared with a standard sewing machine;

an output shaft receiving the oscillating motion from the conversion mechanism, the output shaft being connected to the conversion mechanism in a right-to-left inverted relation when the uppermost point of the needle bar is used as a reference, as compared to a standard sewing machine; and a driver connected to the output shaft for driving the shuttle hook.

2. A shuttle hook driving device according to claim 1, wherein the conversion mechanism comprises an oscillating rock member, and wherein a position of the oscillating rock member is right-left inverted as compared with the standard sewing machine.

3. A shuttle hook driving device according to claim 1 or 2, wherein the counter balance is mounted on the main shaft such that the counter balance is positioned at an angle of about 7° with respect to the main shaft in a direction opposite to a rotational direction of the main shaft as compared with the standard sewing machine.

4. A sewing machine comprising:

a main shaft;

a needle bar;

a thread take-up lever;

a counter balance connected to the needle bar and the thread take-up lever, the counter balance being mounted on the main shaft such that the counter balance is positioned at a predetermined angle with respect to the main shaft as compared with a standard sewing machine;

conversion means for converting a rotation of the main shaft into an oscillating motion;

an output shaft receiving the oscillating motion from the conversion mechanism, the output shaft being connected to the conversion mechanism in a right-to-left inverted relation, as compared with the standard sewing machine, when a top dead center of the needle bar is used as a reference;

a bobbin including a bobbin thread;

a shuttle hook having a beak disposed between a needle drop position and a bobbin thread lead-out point of the bobbin; and a driver connected to the output shaft, for driving the shuttle hook.

5. A sewing machine according to claim 4, wherein said conversion means comprises an oscillating rock member, and wherein a position of the oscillating rock member is right-left inverted as compared with the standard sewing machine.

6. A sewing machine according to claim 4 or 5, wherein the counter balance is mounted on the main shaft in such a manner that the counter balance is positioned at an angle of about 7° with respect to the main shaft in a direction opposite to a rotational direction of the main shaft as compared with the standard sewing machine.

* * * * *